United States Patent [19]

Altier

[11] 4,309,975

[45] Jan. 12, 1982

[54] ARCHERY BOWSTRING RELEASE

[76] Inventor: Anthony L. Altier, P.O. Box 286, Honesdale, Pa. 18431

[21] Appl. No.: 60,887

[22] Filed: Jul. 26, 1979

[51] Int. Cl.[3] ..... F41B 5/00

[52] U.S. Cl. ..... 124/35 A

[58] Field of Search ..... 124/35 A, 35 R, 86, 124/24 R, 23 R, 41 A; 24/73 SA, 73 AP, 115 K, 243 C; 272/74, 75, 117, 143, 125

[56] References Cited

U.S. PATENT DOCUMENTS

| | | | |
|---|---|---|---|
| D. 255,824 | 7/1980 | MacWilliams et al. | 124/35 A X |
| 1,751,488 | 3/1930 | Meyer | 124/35 R X |
| 2,972,461 | 2/1961 | Balbach et al. | 24/73 SA X |
| 3,460,788 | 8/1969 | Goldman | 24/73 SA X |
| 3,567,165 | 3/1971 | White | 24/73 SA X |
| 3,604,407 | 9/1971 | Wilson | 124/35 A |
| 3,800,774 | 4/1974 | Troncoso | 124/35 A |

*Primary Examiner*—Richard C. Pinkham
*Assistant Examiner*—William R. Browne
*Attorney, Agent, or Firm*—Dennison, Meserole, Pollack & Scheiner

[57] ABSTRACT

The bowstring release includes a rigid handle having opposed rounded edges, one of which, at a first end of the handle, is provided with a projecting shoulder and a recess defined inwardly thereof. A string engaging loop of nylon rope or the like has the free ends thereof fixed to the second edge of the handle adjacent the first end of the handle with the bight portion of the loope selectively engageable about the handle end and inward of the shoulder for a thumb-pressure retention thereof. A finger encircling gripping strap is provided along the second edge of the handle with a single fastening element mounting both the strap and the loop.

3 Claims, 7 Drawing Figures

ARCHERY BOWSTRING RELEASE

BACKGROUND OF THE INVENTION

The invention herein is principally concerned with the provision of means for facilitating the drawing and release of a bowstring. Historically, this has been effected by a curling of the three middle fingers of the hand about the string, normally both above and below the nock end of the arrow, rearwardly drawing the spring, and slowly uncurling the fingers so as to allow the string to slide therefrom.

The use of the fingers in this manner can cause difficulties both in achieving a proper release of the arrow, the string being engaged by three separate fingers, and by abrasion to the fingers themselves.

Much effort has been directed to providing mechanical means for assisting in the drawing and release of bowstrings. The following patents are known to applicant and considered representative of efforts directed toward achieving an effective means for drawing and releasing bowstrings other than by a direct finger engagement with the string.

| | |
|---|---|
| 3,072,115 Johnson | 3,929,120 Barner |
| 3,604,407 Wilson et al | 3,952,720 Wilson |
| 3,800,774 Troncoso, Jr. | 4,004,564 Castonguay |
| 3,845,752 Barner | 4,022,181 Fletcher |

In many instances, as represented by the majority of the above patents, some form of complex trigger release or mechanism is used. U.S. Pat. No. 3,604,407, to Wilson et al, provides a hand-received handle, a finger encircling strap, and a flat string encircling combined strap and reinforcing piece which is engaged against and held to one side of the handle by thumb pressure until a release of the string is desired. In use, the thumb must exert a substantial inward and rearward pressure on the combination strap to prevent a premature forward release thereof.

SUMMARY OF THE INVENTION

The bowstring release of the present invention, incorporating a hand-received handle, gripping strap and string engaging rope loop, constitutes a significant improvement over the devices heretofore proposed, and in particular the above detailed Wilson et al release, in allowing for a direct thumb control over the holding and release of the string without requiring the awkward and inexact retention of the string encircling member solely by the reacting force developed by the thumb.

Basically, the handle of the present invention includes a shoulder at the forward end thereof with a recess defined immediately therebehind to receive the end of the string engaging member or loop, this end generally encircling the end of the handle itself. By engagement of the looped end or bight portion of the loop behind the smoothly rounded and tapered shoulder, a retention thereof only requires sufficient thumb pressure to maintain the bight portion behind the shoulder with the shoulder itself accommodating the major forward force component developed by the tensioned string. Upon release of the thumb pressure, the string engaged loop, which incidentally is preferably of a smooth braided nylon, easily slides over the rounded and smoothly tapered shoulder so as to effect the string release. The release is instantaneous with the string moving smoothly from the flexible loop.

DESCRIPTION OF THE PREFERRED EMBODIMENTS

Figure 1:
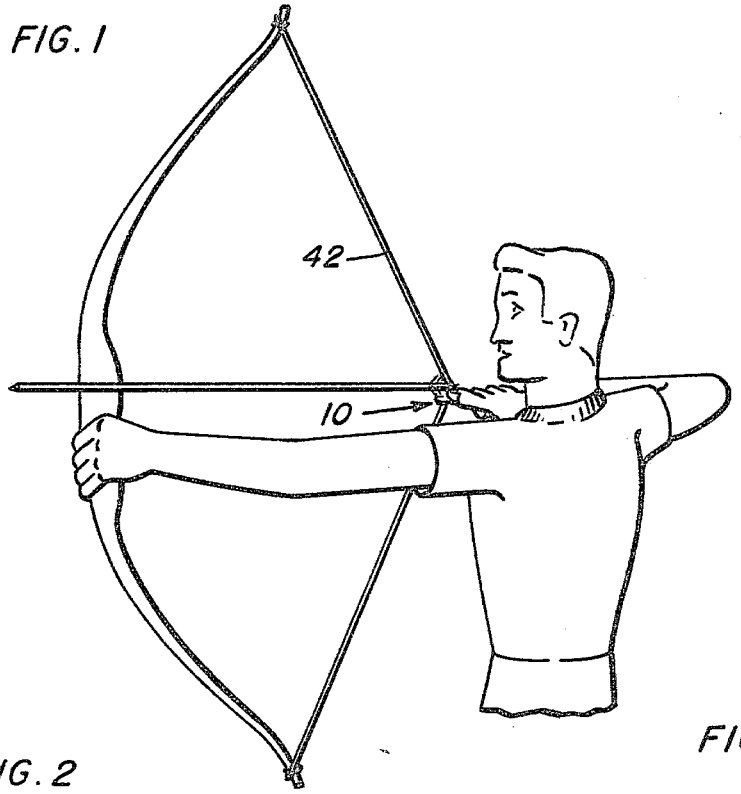
FIG. 1 is an elevational view illustrating the in-use environment of the bowstring release of the present invention.

Referring now more specifically to the drawings, reference numeral 10 designates the archery bowstring release comprising the present invention. This release 10 includes three major components, a handle 12, a string-engaging loop 14, and a finger encircling strap 16.

The handle 12, preferably formed of wood or molded plastic, is provided with smoothly rounded edges and ends so as to be comfortably received within and conform to the hand of a user. The opposed longitudinal edges of the handle 12, which consist of an inner edge 18 adapted to seat in the palm of the user, and a second outer edge 20 adapted to have the user's fingers wrapped thereover, converge from a relatively wide rounded inner or butt end portion 22 to a relatively narrow leading rounded outer end portion 24. The handle is completed by the provision of a smoothly rounded rearwardly directed shoulder portion 26 on the inner palm seating edge 18 of the handle 12 at the leading end portion 24 of the handle. This shoulder 26 defines, or is defined by, an arcuate recess 28 formed immediately inward thereof.

The string engaging loop 14 is formed preferably of highly flexible smooth braised nylon rope. The opposed ends of the rope, generally designated at 30, are positioned in parallel contacting relation with each other and received through a mounting and retaining collar 32. The slightly projecting ends of the rope loop, immediately beyond the collar 32, are preferably slightly enlarged, by a fusing thereof or the application of an adhesive coating, to enhance the fixing of the rope within the collar.

The loop 14 is fixed to the outer finger receiving edge 20 of the handle by an appropriate fastener, such as a screw 34, extending through the rope end receiving collar 32 and into the handle itself. This screw 32 will normally be in general alignment with or slightly rearward of the recess 28 in the opposed edge of the handle 12.

The final component of the bowstring release is the strap 16. This strap 16 is adapted to encircle the handle-gripping fingers, which engage over the outer edge 20 of the handle 12, to provide for a more secure grasping of the release 10 particularly during the drawing of the bow. The strap 16 includes an inner end portion 36 which underlies the collar 32, and an outer end portion 38 having a series of apertures 40 spaced therealong for selective reception of the mounting screw 34 therethrough to provide for a degree of adjustability in the strap 16. The strap 16, between the ends thereof which mount by means of the single loop mounting screw 34, folds or loops rearward along the outer edge 20 of the handle 12, extending normally to approximately the inner end portion 22 of the handle. However, this can vary by selective use of the apertures 40 to accommodate the hand, or more particularly the fingers, of the individual user.

Figure 3:
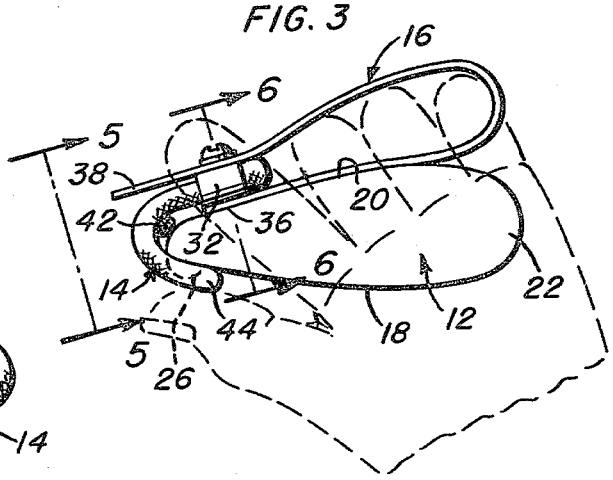
FIG. 3 is a plan view of the release in operative use in engagement with a bowstring.
Figure 4:
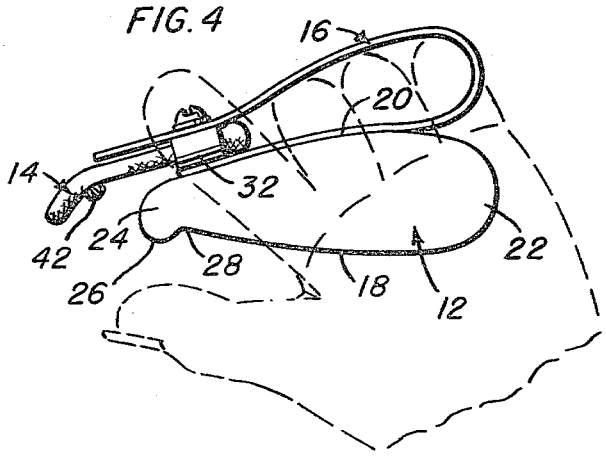
FIG. 4 is a plan view similar to FIG. 3 illustrating the release immediately following release of the string-engaging loop.

In use, the release 10 is grasped in the manner illustrated in FIGS. 3 and 4. Basically, the three rear fingers, the middle finger, the ring finger and the little finger, are positioned through the strap 16 with the handle slid inward toward the base of the fingers and the fingers wrapped over the handle so as to firmly seat the handle within the palm. The index finger is positioned over the head of the screw 34, generally over the collar received inner ends of the loop 14 and opposed to the recess 28. The thumb is then in a position to apply direct pressure in the vicinity of the recess 28, directly opposed to the pressure which can be applied by the overlying index finger.

Figure 5:
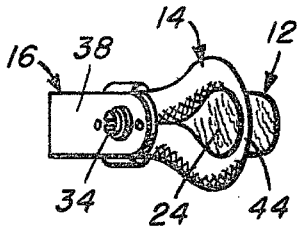
FIG. 5 is a front elevational view of the release taken substantially on a plane passing along line 5—5 in FIG. 3.
Figure 6:
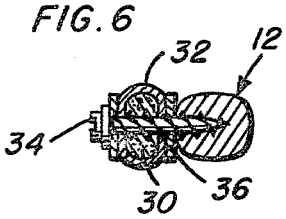
FIG. 6 is a cross-sectional detail taken substantially on a plane passing along line 6—6 in FIG. 3.
Figure 2:
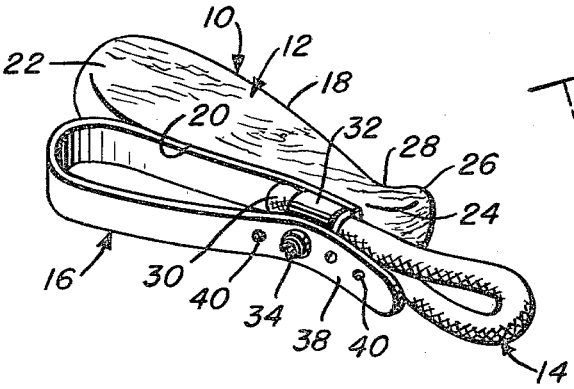
FIG. 2 is an enlarged perspective view of the bowstring release.

After a grasping of the release 10 in the hand of a user, the flexible loop 14 is passed over the bowstring 42 and looped over the end portion 24 of the handle 12 as suggested in FIGS. 3 and 5, with the bowstring 42 positioned between the loop 14 and the handle end portion 24.

With continued reference to FIGS. 3 and 5, it will be appreciated that the loop 14 is of a length so as to be completely received over the end portion 24 with the bight portion 44 of the loop seated behind the shoulder 26, within the recess 28. The two side portions of the loop will normally lie adjacent the opposed sides of the handle end portion 24, providing in effect an encircling of this end portion and a transverse positioning of the bight portion 44 across the full width of the inner edge 18 of the handle 12 within the recess 28. When so positioned, the user's thumb is engaged with the recess-received bight portion 44 and an inward pressure exerted, such an action being greatly facilitated by the overlying index finger acting generally in a direction opposed from the direction of action of the thumb.

By firmly seating the bight portion 44 within the recess 28, behind the shoulder 26, the shoulder itself accommodates substantially the entire resistance required against forward movement of the loop 14 during the drawing and rearward maintaining of the bowstring 42. The major force component, and in fact substantially the entire force developed by the thumb, is directed generally perpendicular to the recess with there being little if any necessity for the development by the thumb of any appreciable force component resisting the forward sliding of the bight portion 44 in that the forward shoulder, notwithstanding the smoothly rounded nature thereof, functions as an effective means for retaining the recess-seated loop.

When release of the arrow is desired, the user's thumb is merely shifted outward. This in turn releases the loop or bight portion 44 with the bowstring 42 simultaneously releasing. The flexible nature of the loop 14, in addition to the smoothly rounded configuration of the shoulder 26, allows for an immediate retraction of the loop 14 to allow the string to travel freely therebeyond. The surface smoothness and highly flexible nature of the loop insures an instantaneous release of the string in a manner which provides for a true forward discharge of the arrow. In this regard, as the shoulder constitutes the major means retaining the loop against the tension of the string, the release of the string is instantaneous and without slippage or the like which might occur were the loop retained against a flat surface, as in U.S. Pat. No. 3,604,407, solely by the frictional resistance developed by the thumb.

Figure 7:
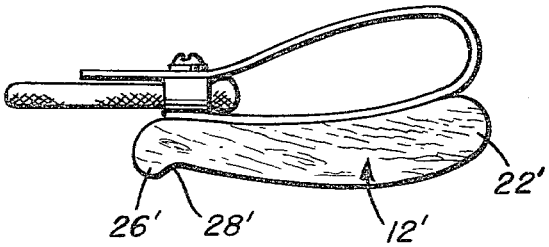
FIG. 7 is a plan view of a bowstring release incorporating a modified form of handle.

FIG. 7 is a view of a modified form of release, differing from the aforedescribed release only in that the handle, herein designated by reference numeral 12', is of a relatively thinner configuration, including a generally constant cross-section throughout the length thereof from the inner palm received end 22' to the outer end 24' incorporating the retaining shoulder 26' and the bight-receiving recess 28' immediately therebehind. The remaining structure, as well as the manner of use, of the embodiment of FIG. 7 is as described above.

The foregoing is considered illustrative of the principles of the invention. Since modifications and changes may occur to those skilled in the art, it is not desired to limit the invention to the exact construction and operation shown and described. Accordingly, all suitable modifications and equivalents may be resorted to, falling within the scope of the invention as claimed.

I claim:

1. A bowstring release including an elongated rigid handle, said handle being receivable in the hand of a user and comprising a first edge adapted to seat in the palm of the user, an opposed second edge adapted to have the user's fingers wrap thereabout, an inner hand receivable end and an opposed projecting outer end, a string engaging loop, said loop having a central bight portion and an opposed end portion, means fixing the end portion of the loop to the handle with the loop projecting beyond the outer end of the handle a distance sufficient to engage about a bowstring and selectively position the loop about said outer end to engage the bight portion of the loop with the first edge of said handle adjacent the outer end of the handle, said first edge of the handle including a recess defined therein and configured to receive the bight portion of said loop, and a smoothly contoured shoulder on said first edge immediately outward of said recess and adjacent said outer end of the handle for a selective retention of the bight portion of the loop therebehind and within the recess upon application of retaining pressure on said loop generally perpendicular to the recess, said loop being of a width greater than that of the outer end of the handle to enable projection of the outer end of the handle through said loop.

2. The bowstring release of claim 1 wherein the means fixing the end portion of the loop to the handle includes a collar received about the end portion of the loop and a fastened element received through the collar and engaged into the second edge of the handle.

3. A bowstring release including an elongated rigid handle, said handle being receivable in the hand of a user and comprising a first edge adapted to seat in the palm of the user, an opposed second edge adapted to have the user's fingers wrap thereabout, an inner hand receivable end and an opposed projecting outer end, a string engaging loop, said loop having a central bight portion and an opposed end portion, means fixing the end portion of the loop to the handle with the loop projecting beyond the outer end of the handle a distance sufficient to engage about a bowstring and selectively position the loop about said outer end to engage the bight portion of the loop with the first edge of said handle adjacent the outer end of the handle, said first edge of the handle including a projecting shoulder adjacent to and tapering outwardly toward the outer end of the handle for a selective reception and retention of the bight portion of the loop therebehind upon application of retaining pressure on said loop generally perpendicular to said first edge, said loop being of a width greater than that of the outer end of the handle to enable projection of the outer end of the handle into said loop.

* * * * *